US012497148B2

(12) United States Patent
Bruneau et al.

(10) Patent No.: US 12,497,148 B2
(45) Date of Patent: Dec. 16, 2025

(54) JET PUMP HOUSING WITH COOLING CHANNELS

(71) Applicant: TAIGA MOTORS INC., Lasalle (CA)

(72) Inventors: Samuel Bruneau, Montréal (CA); Clovis Roy-Bernier, Montreal (CA)

(73) Assignee: TAIGA MOTORS INC., Lasalle (CA)

( * ) Notice: Subject to any disclaimer, the term of this patent is extended or adjusted under 35 U.S.C. 154(b) by 638 days.

(21) Appl. No.: 17/942,301

(22) Filed: Sep. 12, 2022

(65) Prior Publication Data

US 2023/0084989 A1 Mar. 16, 2023

Related U.S. Application Data

(60) Provisional application No. 63/243,769, filed on Sep. 14, 2021.

(51) Int. Cl.

| | |
|---|---|
| ***B63H 11/08*** | (2006.01) |
| ***F04F 5/10*** | (2006.01) |
| ***F04F 5/44*** | (2006.01) |

(52) U.S. Cl.

CPC ..... *B63H 11/08* (2013.01); *F04F 5/10* (2013.01); *F04F 5/44* (2013.01)

(58) Field of Classification Search

CPC .. B63H 11/00; B63H 11/08; F04F 5/00; F04F 5/44

USPC ..... 440/38, 88 C, 88 L

See application file for complete search history.

(56) References Cited

U.S. PATENT DOCUMENTS

| | | | | |
|---|---|---|---|---|
| 3,292,373 | A * | 12/1966 | Tado | F01P 11/08 440/88 L |
| 6,869,324 | B2 * | 3/2005 | Matsuda | B63H 11/10 440/88 C |
| 2005/0266744 | A1 * | 12/2005 | Gardner | B63H 11/08 440/88 C |

* cited by examiner

*Primary Examiner* — Lars A Olson

(74) *Attorney, Agent, or Firm* — Norton Rose Fulbright Canada LLP

(57) ABSTRACT

A jet pump housing is mountable to a hull of a personal watercraft. The jet pump housing comprises a body extending between an inlet and an outlet. The body has an inner wall delimiting an interior of the body and an outer wall. The inner wall and the outer wall are configured to be exposed to water during use of the personal watercraft. The body is shaped and sized to allow water to flow into the interior via the inlet and to expel water from the outlet. The body has one or more fluid passages positioned between the inner wall and the outer wall. The one or more fluid passages are fluidly isolated from the water and are in heat exchange relationship with the water via one or both of the inner wall and the outer wall.

20 Claims, 7 Drawing Sheets

JET PUMP HOUSING WITH COOLING CHANNELS

CROSS-REFERENCE TO RELATED APPLICATION(S)

This application claims priority from U.S. Provisional Patent Application No. 63/243,769, filed Sep. 14, 2021, which is incorporated by reference in its entirety herein.

TECHNICAL FIELD

The application relates generally to personal watercraft and, more particularly, to thermal management in personal watercraft.

BACKGROUND

Electric components on electric vehicles, such as personal watercraft for example, may need to be cooled to prevent the electric components from overheating and to optimise their performance.

SUMMARY

There is disclosed a personal watercraft, comprising: a jet propulsion system, including: a housing extending between an inlet and an outlet, the housing having an inner wall delimiting an interior of the housing and an outer wall, the inner wall and the outer wall configured to be exposed to water during use of the personal watercraft, the housing having one or more fluid passages positioned between the inner wall and the outer wall, the one or more fluid passages fluidly isolated from the water and in heat exchange relationship with the water via one or both of the inner wall and the outer wall; and an impeller positioned within the interior of the housing and rotatable about an impeller axis to draw the water into the interior via the inlet and to expel water from the outlet; and a thermal management system having a pump and fluid lines extending between the pump and the one or more fluid passages, the pump operable to convey a thermal transfer fluid through the fluid lines to one or more components of the personal watercraft to absorb heat from the one or more components, the pump operable to convey the thermal transfer fluid through the fluid lines to the one or more fluid passages to release the heat to the water.

There is disclosed a jet pump housing mountable to a hull of a personal watercraft, the jet pump housing comprising: a body extending between an inlet and an outlet, the body having an inner wall delimiting an interior of the body and an outer wall, the inner wall and the outer wall configured to be exposed to water during use of the personal watercraft, the body shaped and sized to allow water to flow into the interior via the inlet and to expel water from the outlet, the body having one or more fluid passages positioned between the inner wall and the outer wall, the one or more fluid passages fluidly isolated from the water and in heat exchange relationship with the water via one or both of the inner wall and the outer wall.

There is disclosed a method of cooling a thermal transfer fluid during operation of a personal watercraft, the method comprising: conveying the thermal transfer fluid through one or more fluid passages within a housing of a jet pump of the personal watercraft to release heat from the thermal transfer fluid to water flowing around the one or more fluid passages.

There is disclosed a method of manufacturing a housing for a jet pump of a personal watercraft, the method comprising: forming an interior of the housing; and forming one or more fluid passages in the housing to be in heat exchange relationship with one or both of an inner wall of the housing delimiting the interior and an outer wall of the housing.

There is disclosed a personal watercraft, comprising: a hull defining a water intake extending along a bottom portion of the hull, the water intake defining an opening covered by a grate; a ride plate positioned along the bottom portion of the hull; a pump shoe extending between the grate and the ride plate; one or more fluid passages positioned in one or both of the grate and the pump shoe; and a thermal management system having a pump and fluid lines extending between the pump and the one or more fluid passages, the pump operable to convey a thermal transfer fluid through the fluid lines to one or more components of the personal watercraft to absorb heat from the one or more components, the pump operable to convey the thermal transfer fluid through the fluid lines to the one or more fluid passages to release the heat to the water.

DESCRIPTION OF THE DRAWINGS

Reference is now made to the accompanying figures in which.

DETAILED DESCRIPTION

The following disclosure relates to straddle seat vehicles and associated methods for operating the straddle seat vehicles. The straddle seat vehicles are drivingly engaged to drive systems for effecting propulsion of the vehicles in both a forward and reverse direction. The drive systems may comprise an electric motor or a combustion engine for driving a jet pump to effect propulsion. In some embodiments, the straddle seat vehicles and methods described herein may be applicable to powersport vehicles that may be operated off-road and/or in relatively rugged environments. Examples of suitable off-road powersport vehicles include snowmobiles, personal watercraft (PWCs), all-terrain vehicles (ATVs), and utility task vehicles (UTVs). As used herein, the term off-road vehicle refers to vehicles to which at least some regulations, requirements or laws applicable to on-road vehicles do not apply. In some embodiments, the vehicles and methods described herein may, based on one or more positions of an input device operatively connected to an electric motor, determine the forward direction and reverse direction of propulsion for the vehicle.

The terms "connected", "connects" and "coupled to" may include both direct connection and coupling (in which two elements contact each other) and indirect connection and coupling (in which at least one additional element is located between the two elements).

The following disclosure relates to electric watercraft, but could also be applicable to combustion engine or hybrid (electric and combustion) watercraft. Examples of suitable electric watercraft include personal watercraft (PWC) having a straddle seat for accommodating an operator and optionally one or more passengers.

Figure 1:
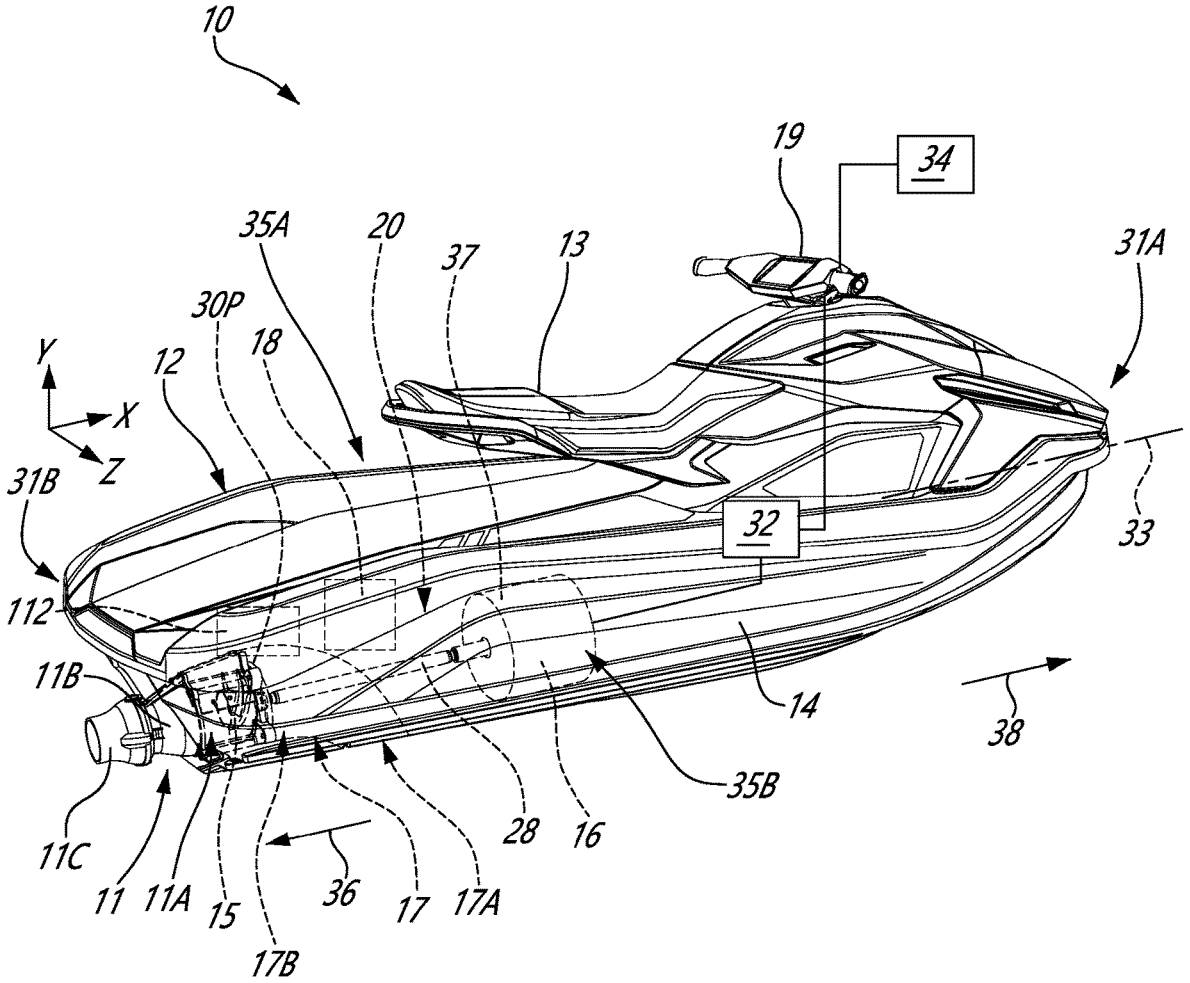
FIG. 1 is a perspective view of a watercraft.

FIG. 1 illustrates a watercraft 10 of a type preferably used for transporting one or more passengers over a body of water. The watercraft 10 is therefore sometimes referred to herein as a "personal watercraft 10" or "PWC 10". The PWC 10 of FIG. 1 is electrically powered. An upper portion of the PWC 10 is formed of a deck 12 including a straddle seat 13 for accommodating a driver of the PWC 10 and optionally one or more passengers. A lower portion of the PWC 10 is formed of a hull 14 which sits in the water. The hull 14 and the deck 12 enclose an interior volume 37 of the PWC 10 which provides buoyancy to the PWC 10 and houses components thereof. A non-limiting list of components of the PWC 10 that may be located in the interior volume 37 include an electric motor 16, one or more electric batteries 18, a thermal management system 112, and other components for an electric drive system 20 of the PWC 10. The hull 14 may also include strakes and chines which provide, at least in part, riding and handling characteristics of the PWC 10. The interior volume 37 may also include any other components suitable for use with PWC 10, such as storage compartments, for example.

The PWC 10 includes a jet propulsion system 11 to create a pressurized jet of water which provides thrust to propel the PWC 10 through the water. The jet propulsion system 11 includes a rotatable impeller 15 disposed in the water to draw water through a water intake 17 on an underside of the hull 14, with the water being directed to a jet pump 11A. The water intake 17 is a passage formed by walls of the hull 14, and extends downstream from an opening in the underside of the hull 14 to an upright, internal rear wall 14A of the hull 14. The water intake 17 is in the form of a ramp which extends from a water intake inlet 17A at the opening in the underside of the hull 14, to a water intake outlet 17B at internal rear wall 14A. The water intake inlet 17A is covered by a grate 17C (see FIG. 3B) or other body to prevent the ingress of debris into the water intake 17. Water ejected from the jet pump 11A is directed through a venturi 11B which further accelerates the water to provide additional thrust. The accelerated water jet is ejected from the venturi 11B via a pivoting steering nozzle 110 which is directionally controlled by the driver with a steering mechanism 19 to provide a directionally controlled jet of water to propel and steer the PWC 10.

The electric drive system 20 of the PWC 10 includes one or more of the electric motors 16 (referred hereinafter in the singular) drivingly coupled to the impeller 15 via a drive shaft 28. The drive shaft 28 transfers motive power from the electric motor 16 to the impeller 15. The electric drive system 20 also includes the batteries 18 (referred hereinafter in the singular) for providing electric current to the electric motor 16 and driving the electric motor 16. The operation of the electric motor 16 and the delivery of drive current to the electric motor 16 may be controlled by a controller 32 based on an actuation by the driver of an accelerator 34, sometimes referred to as a "throttle", on the steering mechanism 19, among other inputs. In some embodiments, the battery 18 may be a lithium ion or other type of battery 18. In various embodiments, the electric motor 16 may be a permanent magnet synchronous motor or a brushless direct current motor for example.

Referring to FIG. 1, the PWC 10 moves along a rear or aft direction of travel 36 and along a forward direction of travel 38. The forward direction of travel 38 is the direction along which the PWC 10 travels in most instances when displacing. The aft direction of travel 36 is the direction along which the PWC 10 displaces only occasionally, such as when it is reversing. The PWC 10 includes a bow 31A and a stern 31B defined with respect to the aft and forward directions of travel 36,38, in that the bow 31A is positioned ahead of the stern 31B relative to the forward direction of travel 38, and that the stern 31B is positioned astern of the bow 31A relative to the aft direction of travel 36. The PWC 10 defines a longitudinal center axis 33 that extends between the bow 31A and the stern 31B. A port side 35A and a starboard side 35B of the PWC 10 are defined on opposite lateral sides of the center axis 33. The positional descriptors "front", "aft" and "rear" and terms related thereto are used in the present disclosure to describe the relative position of components of the PWC 10. For example, if a first component of the PWC 10 is described herein as being in front of, or forward of, a second component, the first component is closer to the bow 31A than the second component. Similarly, if a first component of the PWC 10 is described herein as being aft of, or rearward of, a second component, the first component is closer to the stern 31B than the second component. The PWC 10 also includes a three-axes frame of reference that is displaceable with the PWC 10, where the Y-axis is parallel to the vertical direction, the X axis is parallel to the center axis 33, and the Z-axis is perpendicular to both the X and Y axes and defines a lateral direction between the port and starboard sides 35A,35B. Features and components are described and shown in the present disclosure in relation to the PWC 10, but the present disclosure may also be applied to different types of watercraft 10, such as other boats or other vessels, used to transport people and/or cargo.

Figure 2:
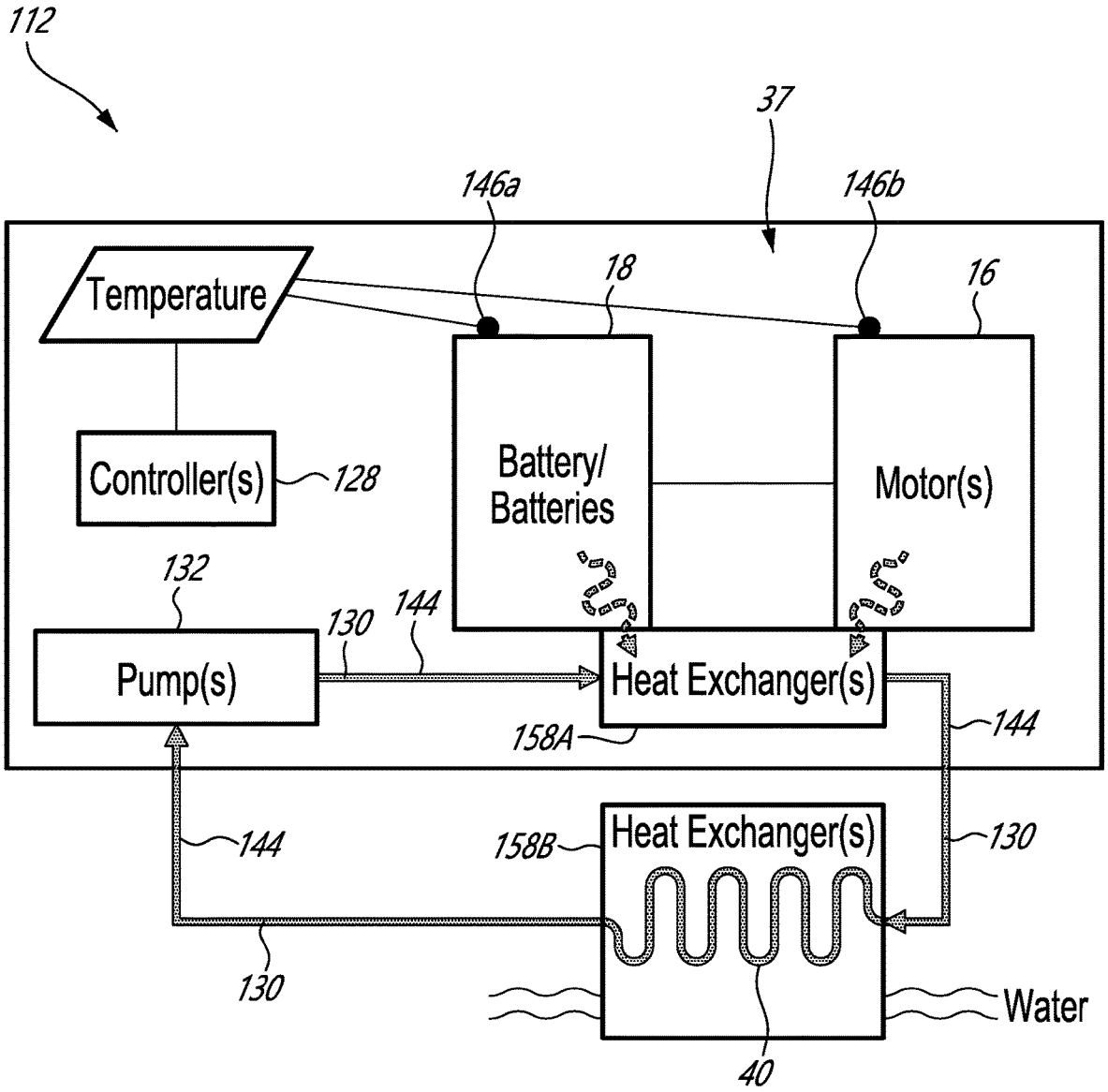
FIG. 2 is a schematic representation of a thermal management system of the watercraft of FIG. 1.

The thermal management system 112 may be used for heating and/or cooling components of the PWC 10. Referring to FIG. 2, the thermal management system 112 may include a controller 128, one or more pumps 132 (referred hereinafter in the singular), one or more fluid lines 144, and one or more heat exchangers 158A, 158B. The controller 128 governs operation of the pump 132 so that the pump 132 can convey under pressure a thermal transfer fluid 130 through the fluid lines 144 to absorb and/or release heat to/from components of the PWC 10. The thermal transfer fluid 130 may be any suitable heat transfer fluid (e.g., liquid) capable of carrying heat and may be selected based on the expected operating temperature of PWC 10 or its components that require thermal management. In various embodiments, the thermal transfer fluid 130 may be oil, water or a water-glycol solution for example. The thermal management system 112 may include other components as well, such as valves, reservoirs, vents, and any other component associated with fluid transport systems.

Referring to FIG. 2, the pump 132 conveys the thermal transfer fluid 130 towards the batteries 18, to the electric motor 16, and possibly to other components of the PWC 10 as well, via the fluid lines 144, in order to absorb heat from these components of the PWC 10 so that these components may operate within a desired temperature or within a desired range of temperatures and thereby achieve their desired performance. The pump 132 also conveys the thermal transfer fluid 130 from these components, again via the fluid lines 144, in order to release the absorbed heat. In order to achieve this functionality, one or more of the heat exchangers 158A,158B is in thermal communication with the components from which heat must be absorbed, and one or more of the heat exchangers 158A,158B is in thermal communication with an area or region to which the absorbed heat can be released. One possible and non-limiting example of the heat exchangers 158A,158B is now described. Referring to FIG. 2, the heat exchanger 158A is associated with the components of the PWC 10 from which heat must be absorbed (e.g. the battery 18, the electric motor 16, etc.). The pump 132 conveys the thermal transfer fluid 130 to travel through the heat exchanger 158A to absorb heat from these components. The heated thermal transfer fluid 130 is then conveyed to flow through the heat exchanger 158B, which is in thermal communication with a heat sink to which the heat from the thermal transfer fluid 130 can be released. Referring to FIG. 2, the heat sink is the water through which the PWC 10 travels, or in which the PWC 10 is floating. The cooled thermal transfer fluid 130 may then be conveyed back to the pump 132 to begin a new heat-transfer cycle. In an alternate embodiment, one or more of the heat exchangers 158A,158B acts as a heater used to warm components of the PWC 10. For example, in one such configuration, the heat exchanger 158A releases heat from the thermal transfer fluid 130 in order to heat the batteries 18 and/or the motor 16. In some embodiments, the heat transfer path(s) described above may be partially or substantially entirely conductive. The controller 128 may govern the operation of the pump 132, and thus the transfer of heat loads via the thermal transfer fluid 130, using data from the PWC 10. For example, and referring to FIG. 2, the controller 128 may receive temperature data provided by temperature sensor(s) 146*a*, 146*b* associated with one or more of the electronic components (e.g. the battery 18, the motor 16, etc.) requiring cooling. In an embodiment, each of the battery 18 and the motor 16 have multiple temperature sensors 146*a*, 146*b*. The controller 128 may govern the operation of the pump 132 and the resulting flow of the thermal transfer fluid 130 based on the temperature data received from the temperature sensor(s) 146*a*, 146*b*.

Figure 3A:
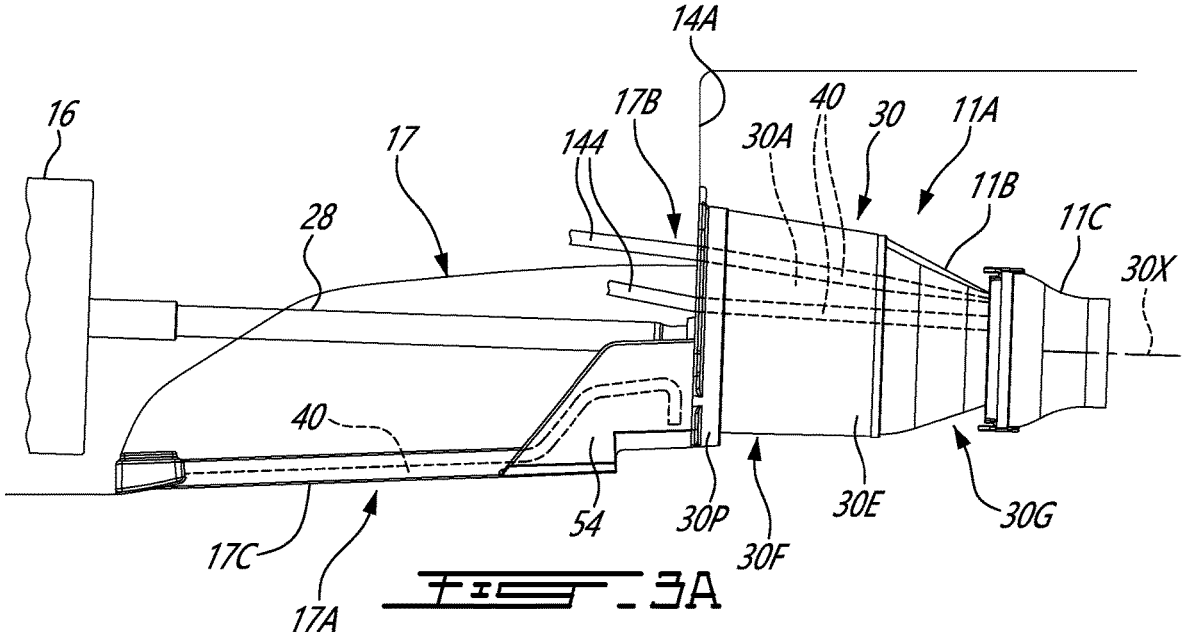
FIG. 3A is a side elevational view of a jet propulsion system of the watercraft of FIG. 1, with lines placing the water intake and tunnel of a hull of the watercraft in context.
Figure 3B:
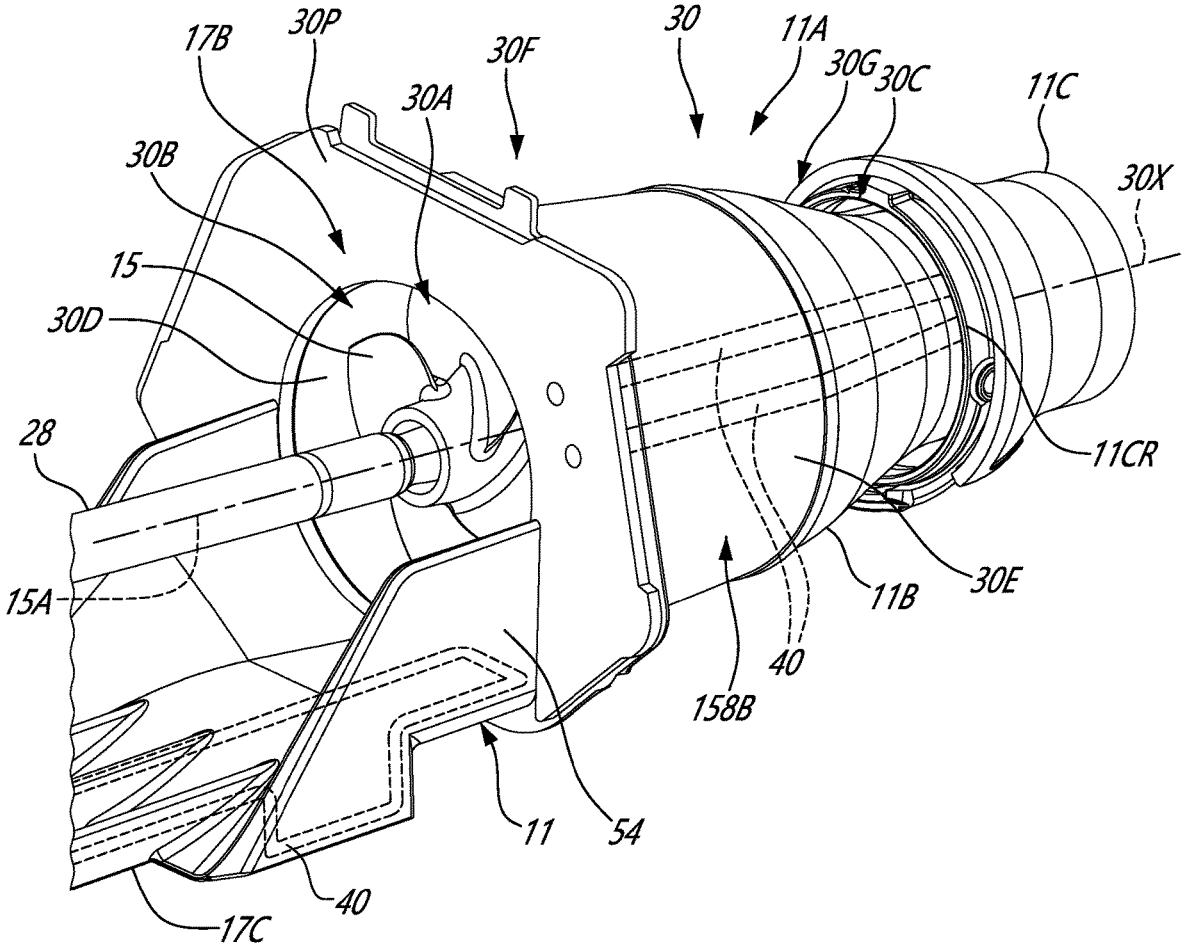
FIG. 3B is a rear perspective view of the jet propulsion system of FIG. 3A.

FIGS. 3A and 3B show features of the jet propulsion system 11, including the impeller 15, the water intake 17, the internal rear wall 14A of the hull 14, the jet pump 11A, the venturi 11B and the pivoting steering nozzle 11C. The jet pump 11A has, or is formed by, a housing 30 (sometimes referred to in this specification as the "jet pump housing"). The housing 30 is a stationary component whose position with respect to the hull 14 is fixed, and which moves with the PWC 10 through the water. Referring to FIGS. 3A and 3B, the housing 30 is fixed in position by being mounted to the internal rear wall 14A of the hull 14 within a jet pump tunnel 14V (see FIG. 5A) formed along an underside of the hull 14. Some or all of the housing 30 may be partly or completely submerged in water during one or more operating phases of the PWC 10. For example, when the PWC 10 is floating in the water or travelling at relatively low speeds through the water in the forward direction, some or all of the housing 30 may be partly or completely submerged in the water. The housing 30 is a hollow body which delimits an interior 30A or cavity. The housing 30 is an elongated body which extends between an inlet 30B through which the water enters the interior 30A via the water intake 17, and an outlet 30C through which the water is expelled from the interior 30A by the impeller 15. The inlet 30B of the housing 30 is in fluid communication, or coincident, with the water intake outlet 17B of the water intake 17. This description of the inlet 30B and the outlet 30C applies even if the direction of water flowing through the interior 30A is reversed, such as when the PWC 10 is reversing and water travels through the interior 30A of the housing 30 from the outlet 30C to the inlet 30B.

The interior 30A of the housing 30 is delimited by an inner wall 30D. In the exemplary illustrated embodiment where the housing 30 is an annular body that defines a housing center axis 30X, the inner wall 30D is an annular body with a circumferential surface. The inner wall 30D may be a component which experiences wear and which may be replaced. The housing 30 has an outer wall 30E that is spaced radially outwardly from inner wall 30D. The outer wall 30E defines the external surface of the housing 30 and may be submerged in water during one or more operating phases of the PWC 10, such as when the PWC 10 is floating or travelling at relatively low forward speeds. Thus, both the inner wall 30D and the outer wall 30E are configured to be exposed to water during one or more operating phases of the PWC 10. More specifically, the water may flow through the interior 30A and thus along or against the inner wall 30D when the PWC 10 is being used, and the outer wall 30E may be partly or completely submerged in water when the PWC 10 is being used. A thickness of the housing 30 may be defined as the distance separating the inner wall 30D from the outer wall 30E, when measured along a line that is normal to aligned surfaces of the inner and outer walls 30D,30E, or when measured along a line that is radial to housing center axis 30X of the cylindrical housing 30.

The housing 30 encloses or houses the impeller 15 and other components such as stator vanes, as described in greater detail below. The impeller 15 is positioned within the interior 30A and is rotatable about an impeller axis 15A to pressurize the water and convey it through the housing 30. The impeller axis 15A is coaxial with the housing center axis 30X. The rotation of the impeller 15 functions to draw the water into the interior 30A via the inlet 30B and to expel the water from the outlet 30B, when the PWC 10 is travelling in the forward direction. Referring to FIG. 3B, the impeller 15 is positioned axially between the inlet 30B and the outlet 30C of the housing 30, relative to the impeller axis 15A and the housing center axis 30X. The impeller 15 may be positioned elsewhere with respect to the inlet and outlet 30B,30C. For example, in an alternate embodiment, the impeller 15 is positioned at the inlet 30B. In another possible embodiment, the impeller 15 is positioned at the outlet 30C. Referring to FIG. 3B, the pivoting steering nozzle 110 is mounted to the housing 30 adjacent to the outlet 30C. A pivot ring 11CR is mounted to the steering nozzle 110, and is displaceable in order to cause displacement of the steering nozzle 11C to provide a directionally controlled jet of water to propel and steer the PWC 10. In an alternate embodiment, the jet propulsion system 11 uses a mechanism other than the steering nozzle 110 to direct the PWC 10, such as a rudder or guide vane.

Referring to FIGS. 3A and 3B, the housing 30 includes an upstream portion 30F and a downstream portion 30G. During forward travel of the PWC 10, the water flows through the interior 30A of the housing 30 from the upstream portion 30F to the downstream portion 30G. In an embodiment, an example of which is shown in FIGS. 3A and 3B, the upstream portion 30F is mounted to the downstream portion 30G, such that the upstream and downstream portions 30G, 30F form two separate components which make up the housing 30. In an alternate embodiment, the upstream and downstream portions 30G,30F are integral with one another and form a one-piece or monolithic housing 30. The inlet 30B of the housing 30 is defined in the upstream portion 30F, and the outlet 30C is defined in the downstream portion 30G. Referring to FIGS. 3A and 3B, the upstream portion 30F has an internal diameter which remains substantially constant along a length of the upstream portion 30F defined along the housing center axis 30X. Referring to FIGS. 3A and 3B, the downstream portion 30G has an internal diameter which decreases along a length of the downstream portion 30G defined along the housing center axis 30X, such that the downstream portion 30G narrows in diameter or converges toward the outlet 30C. Other shapes for the upstream and downstream portions 30F,30G are possible.

The housing 30 of the jet pump 11A and/or other components of the hull 14 or watercraft 10 may contain or define the heat exchanger 158B of the thermal management system 112 described above, where the heat exchanger 158B is in thermal communication with the heat sink (e.g. with the water). The housing 30 of the jet pump 11A thus helps the warmed thermal transfer fluid 130 to shed or release heat absorbed from the electronic components of the PWC 10, and thus contributes to helping the electronic components operate within their optimal temperature ranges.

The heat exchanger 158B may take many forms. For example, and referring to FIGS. 3A and 3B, the heat exchanger 158B is formed, or composed, of one or more fluid passages 40 in the housing 30. The fluid passages 40 are in fluid communication with the fluid lines 144 of the thermal management system 112 to receive the thermal transfer fluid 130 therefrom. The fluid passages 40 are internal conduits or volumes that are present within the body of the housing 30, and are thus in heat-exchange relationship with the water present within and/or around the housing 30 during the operating phases of the PWC 10. The fluid passages 40 function to receive the thermal transfer fluid 130 from the fluid lines 144, to transport the thermal transfer fluid 130 through the housing 30 in order to shed heat from the thermal transfer fluid 130 to the water present within and/or around the housing 30, and to return the cooled thermal transfer fluid 130 to other fluid lines 144 to be conveyed back to the thermal management system 112. In the configuration of the fluid passages 40 shown in FIGS. 3A and 3B, the thermal transfer fluid 130 sheds or loses heat to the water, such that the water acts as a cooling medium for the thermal transfer fluid 130. The fluid passages 40 thus allow the thermal transfer fluid 130 to release the heat it acquired from the electronic components of the PWC 10 to the water when the thermal transfer fluid 130 is flowing through the fluid passages 40. The heat exchange between the thermal transfer fluid 130 in the fluid passages 40 and the water is primarily achieved by convection when the PWC 10 is traveling along the water. The heat exchange between the thermal transfer fluid 130 in the fluid passages 40 and the water is primarily achieved by conduction when the PWC 10 is stationary.

The fluid passages 40 are fluidly isolated from the water. The fluid passages 40 are not in fluid communication with the water. The fluid passages 40 are sealed off from the water present within and/or around the housing 30. The fluid passages 40 thus form closed conduits through which the thermal transfer fluid 130 travels and which prevent the thermal transfer fluid 130 from entering or leaking into the water. Despite their fluid isolation from the water present within and/or around the housing 30, the fluid passages 40 are in heat exchange relationship with the water via one or both of the inner wall 30D and the outer wall 30E, so as to form the heat exchanger 158B and shed excess heat from the thermal transfer fluid 130 to the water Referring to FIG. 2, during operation of the PWC 10, the thermal management system 112 functions to transfer heat from the electronic components of the PWC 10 (e.g. the battery 18, the electric motor 16, etc.) to the water around the jet propulsion system 11. This is achieved by first pumping the thermal transfer fluid 130 through the fluid lines 144 to the heat exchanger 158A associated with the electronic components of the PWC 10 to absorb heat from these components thereby cooling them in the process. The pump 132 functions to then convey the heated thermal transfer fluid 130 through additional fluid lines 144 that extend to, and are in fluid communication with, the fluid passages 40 in the housing 30 that form the heat exchanger 158B. The heated thermal transfer fluid 130 sheds heat via the fluid passages 40 to the water, and is conveyed under pressure through additional fluid lines 144 from outlets of the fluid passages 40 back to the pump 132, where the thermal transfer fluid 130 is pressurized to repeat the heat-transfer cycle. The circuit formed by the pump 132, the heat exchangers 158A,158B, the fluid lines 144, and the fluid passages 40 is a closed circuit, or forms a closed-loop system, which prevents the thermal transfer fluid 130 from leaking into or engaging fluids (e.g. the water) outside of the circuit.

Referring to FIGS. 3A and 3B, the heat exchanger 158B formed by the fluid passages 40 in the housing 30 of the jet pump 11A thus allows for the water from the lake, river, ocean, etc. in which the PWC 10 is located to cool internal electrical components of the PWC 10. Since the flow of water through the interior 30A of the housing 30 or along the outer wall 30E may vary during use of the PWC 10, it may be possible to determine or control the rate of cooling provided by the thermal management system 112 based on the speed of travel of the PWC 10. It may therefore be possible to shed heat in the fluid passages 40 when the PWC 10 is travelling faster such as when the flow rate of fluid within the interior 30A of the housing 30 is greater, which is also when the motor 16 is working hardest and thus could benefit from more cooling. The presence of cooling fluid passages 40 in the housing 30 thus allows for the jet pump housing 30 (the housing around the impeller 15 and optionally the stator vanes) to be used as a heat exchanger.

One possible technique for determining or controlling the rate of cooling provided by the thermal management system 112 based on the speed of travel of the PWC 10 is now described. At low travel speeds, the housing 30 is partly or completely submerged in the water, such that the thermal transfer fluid 130 in the fluid passages 40 can be cooled both by the water flowing along the inner wall 30D and the water flowing along the outer wall 30E of the housing 30, such that the water provides cooling on both the internal and external surfaces of the jet pump housing 30. At high travel speeds, the housing 30 may be partly or completely out of the water (i.e. not submerged), such that the thermal transfer fluid 130 in the fluid passages 40 is cooled primarily or only by the water flowing along the inner wall 30D of the housing 30. However, during typical use of the PWC 10, the operator is not expected to operate the PWC 10 at high travel speeds for long periods of time. During a typical use of the PWC 10, it may be operated at high travel speeds for relatively short periods of time for manoeuvering or for performing tricks, after which the PWC 10 is slowed down. Thus, a typical use of the PWC 10 involves alternating between accelerating and stopping. Therefore, although the warmed thermal transfer fluid 130 in the fluid passages 40 may be exposed to less cooling surface area when the PWC 10 is travelling at relatively high speeds, the PWC 10 is not expected to operate at these speeds for prolonged periods of time, such that the heat exchanger 158B formed by the fluid passages 40 in the housing 30 is still expected to offer sufficient cooling of the thermal transfer fluid 130 at all operating phases of the PWC 10. Furthermore, as the PWC 10 slows down, the housing 30 will once again become submerged within the water thereby exposing the warmed thermal transfer fluid 130 in the fluid passages 40 to water flowing along both the inner wall 30D and outer wall 30E of the housing 30. Therefore, the heat that may have been generated while the PWC 10 was operating at higher travel speeds can be quickly cooled when the PWC 10 is returned to operating at slower speeds. As will be described in more detail below with respect to FIG. 6, the fluid passages 40 within the pump housing 30 provide efficient cooling at least at low speeds.

Referring to FIG. 2, some or all of the components of the thermal management system 112 may be located within the interior volume 37 of the PWC 10. For example, the pump 132, the heat exchanger 158A associated with the electronic components of the PWC 10, and some of the fluid lines 144 may all be present in the interior volume 37. The fluid lines 144 may extend through the interior volume 37 within the hull 14 in a general direction that is parallel to the center axis 33. Some of the fluid lines 144 may be outlet fluid lines 144 that convey the heated thermal transfer fluid 130 through the interior volume 37 and to the fluid passages 40 which are outside of the hull 14 and thus outside of the interior volume 37. Some of the fluid lines 144 may be return fluid lines 144 which convey the cooled thermal transfer fluid 130 through the interior volume 37 from the fluid lines 144 back to the pump 132. It will thus be appreciated that some of the fluid lines 144 extend through the hull 14 to convey the thermal transfer fluid 130 to and from the fluid passages 40. These fluid lines 144 are sealed appropriately to prevent water from entering the interior volume 37.

One possible configuration of the fluid lines 144 is shown in FIGS. 3A and 3B. The housing 30 includes a mounting plate 30P or flange which is abutted against the internal rear wall 14A of the hull 14 which delimits part of the water intake 17. The housing 30 is mounted to the hull 14 by attaching the mounting plate 30P to the internal rear wall 14A, for example with bolts (not shown). One side of the upright internal rear wall 14A faces toward, and partially delimits, the interior volume 37 of the PWC 10. The fluid lines 144 extend through the interior volume 37 inwardly of the walls of the hull 14 which define the water intake 17, and are mounted to or through the internal rear wall 14A to be in fluid communication with the fluid passages 40 in the housing 30 via the mounting plate 30P, for example. The fluid lines 144 are therefore confined to the interior volume 37.

Figure 4A:
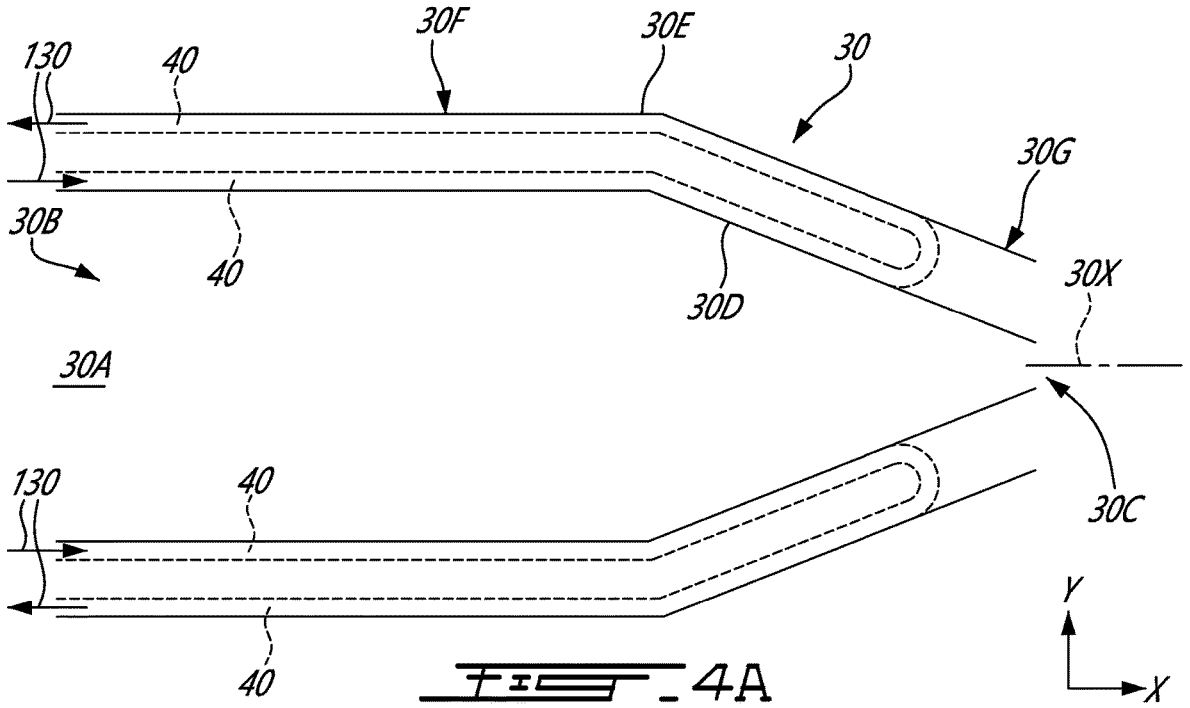
FIG. 4A is a cross-sectional view of a housing of the jet propulsion system of FIG. 3A with fluid passages shown in dotted lines.

The fluid passages 40 may have or assume any shape, orientation and/or position in, or relative to, the housing 30 to achieve their functionality described herein. For example, and referring to FIG. 4A, the fluid passages 40 are positioned between the inner wall 30D and the outer wall 30E of the housing 30. In the configuration of the fluid passages 40 shown in FIG. 4A, some or all of the fluid passages 40 are positioned closer to the inner wall 30D than they are to the outer wall 30E. This positioning of the fluid passages 40 helps improve or augment their heat-transfer effectiveness with the water flowing through the interior 30A of the housing 30. In such an embodiment, the inner wall 30D forms a heat-transfer wall that separates the fluid passages 40 from the interior 30A of the housing 30. Referring to FIG. 4A, the inner wall 30D is the only portion of the housing 30 that separates the thermal transfer fluid 130 in some or all of the fluid passages 40 from the water in the interior 30A. Other positions for the fluid passages 40 within the housing 30 are possible. For example, in an alternate embodiment, and referring to FIG. 4A, some or all of the fluid passages 40 are separated from water around the housing 30 only by the outer wall 30E. In another possible embodiment, some or all of the fluid passages 40 are positioned within the housing 30 spaced equidistantly from the inner wall 30D and from the outer wall 30E. Referring to FIG. 4A, more than one fluid passage 40 is defined in the thickness of the housing 30 measured between the inner and outer walls 30D,30E.

The fluid passages 40 may have or assume any orientation and/or position in, or relative to, the housing 30 to achieve their functionality described herein. For example, and referring to FIG. 4A, one or more of the fluid passages 40 extend (or are present) through one or both of the upstream portion 30F and the downstream portion 30G of the housing 30. The heat transfer effectiveness of the fluid passages 40 may be greater in the convergent downstream portion 30G than in the upstream portion 30F. Referring to FIG. 4A, the fluid passages 40 extend through both the upstream and downstream portions 30F,30G, and thus through the whole length of the housing 30 measured along the housing center axis 30X. In an alternate embodiment, the fluid passages 40 extend, or are present in, only the upstream portion 30F of the housing 30. In an alternate embodiment, the fluid passages 40 extend, or are present in, only the downstream portion 30G of the housing 30.

Referring to FIG. 3A, one or more of the fluid passages 40 may include an inlet supplied with the thermal transfer fluid 130 by one of the fluid lines 144, an outlet in fluid communication with another one of the fluid lines 144 to supply the cooled thermal transfer fluid 130 thereto, and a body which extends through the housing 30 and between the inlet and outlet. In an embodiment, the housing 30 has only one fluid passage 40 that has a length that is longer than the length of the housing 30 measured along the housing center axis 30X, and which extends from an inlet supplied with the thermal transfer fluid 130 by one of the fluid lines 144 to an outlet in fluid communication with another one of the fluid lines 144 to supply the cooled thermal transfer fluid 130 thereto.

Figure 4B:
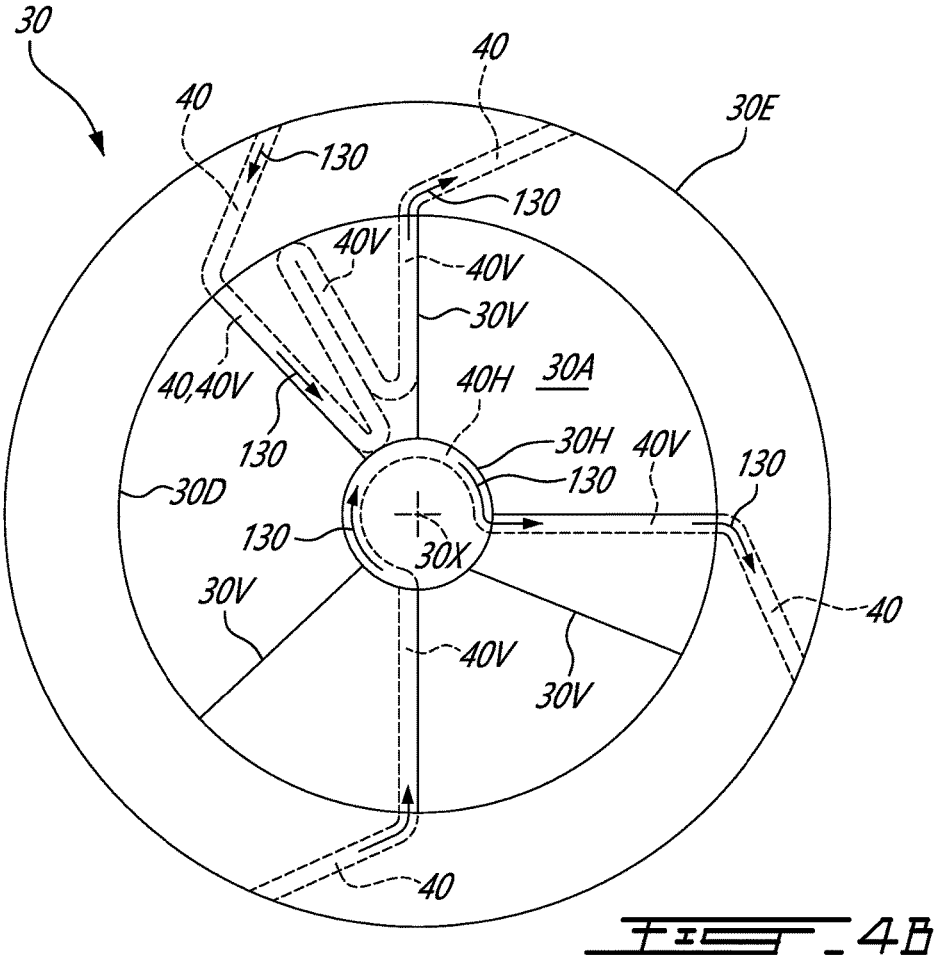
FIG. 4B is an end view of the housing of FIG. 4A according to an alternative embodiment, with fluid passages shown in dotted lines.
Figure 4C:
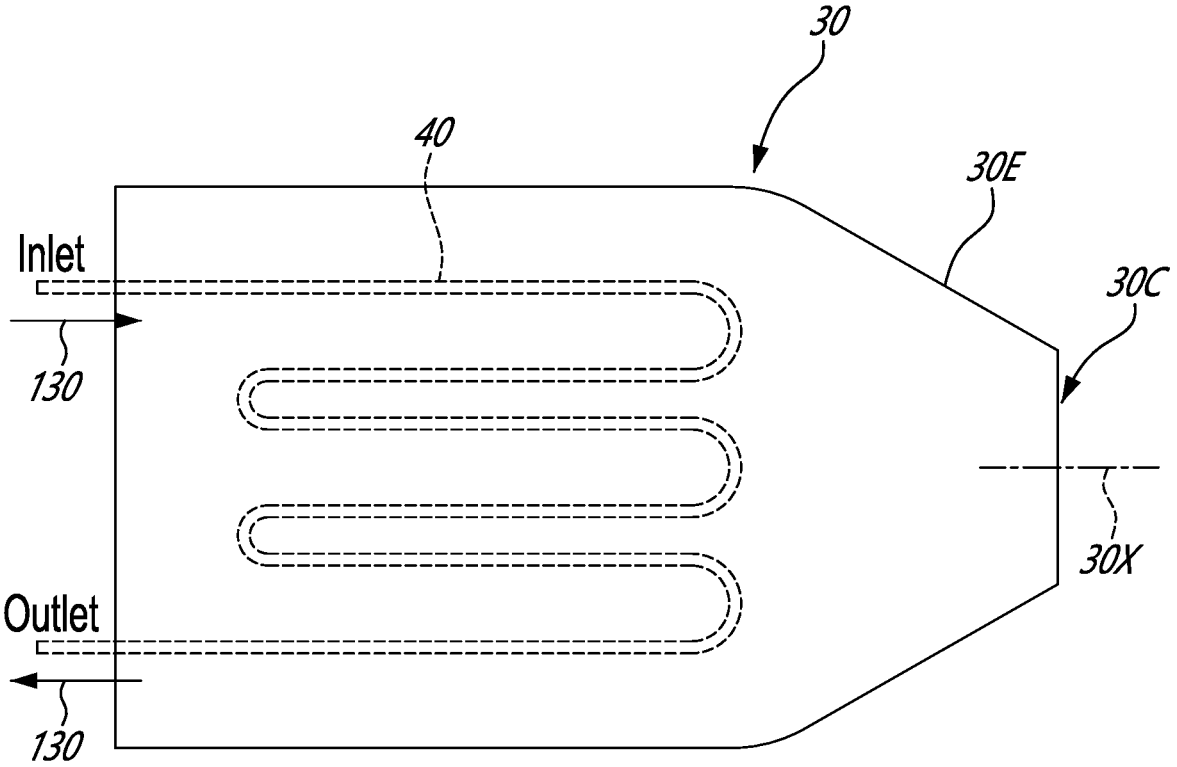
FIG. 4C is a side elevational view of the housing of the jet propulsion system of FIG. 3A, with fluid passages shown in dotted lines.
Figure 4D:
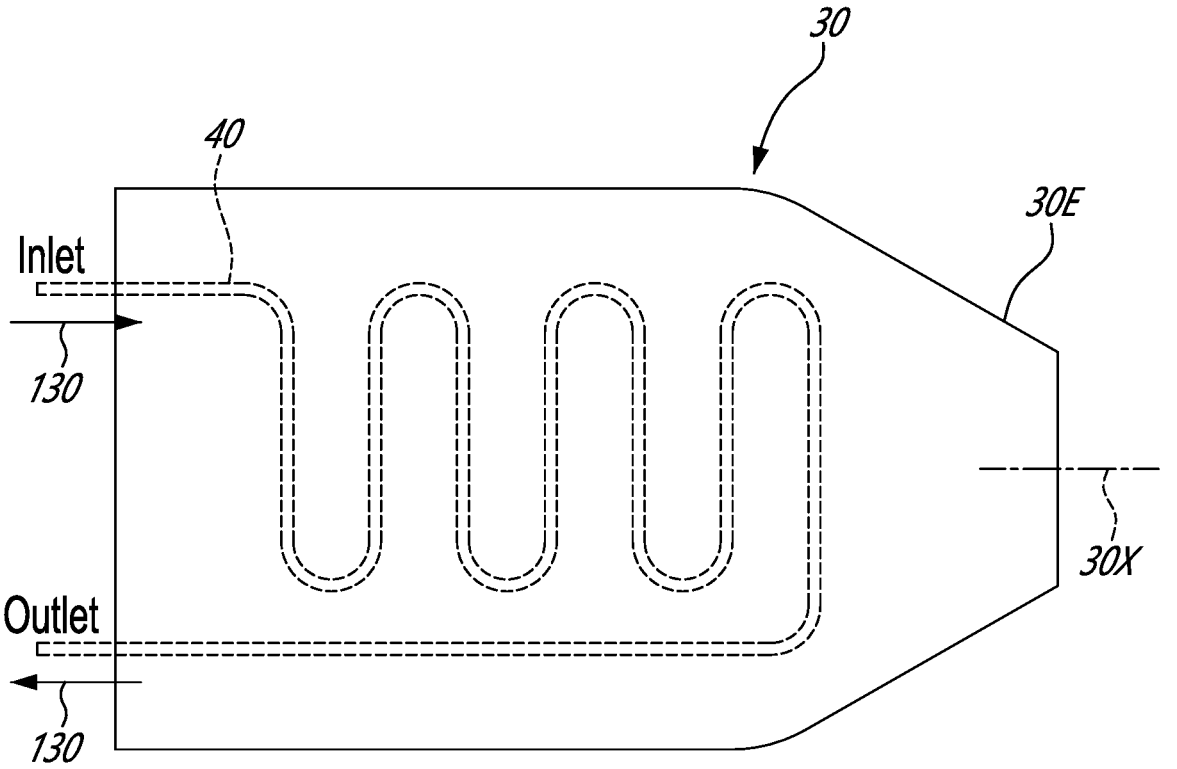
FIG. 4D is a side elevational view of the housing of the jet propulsion system of FIG. 3A according to an alternative embodiment, with fluid passages shown in dotted lines.

One possible example of the single fluid passage 40 configuration is shown in FIG. 4C. The single fluid passage 40 has an inlet supplied with the thermal transfer fluid 130 by one of the fluid lines 144, an outlet in fluid communication with another one of the fluid lines 144 to supply the cooled thermal transfer fluid 130 thereto, and a body which extends through the housing 30 and between the inlet and outlet. The body of the fluid passage 40 has parallel and interconnected segments which have an orientation substantially parallel to the housing center axis 30X. The thermal transfer fluid 130 flows through the segments in a first direction toward the outlet 30C of the housing 30, and in a second direction that is opposite to the first direction. The length of the single fluid passage 40 is longer than the length of the housing 30 measured along the housing center axis 30X. In the configuration shown in FIG. 4C, the single fluid passage 40 is the only fluid passage 40 in the space/thickness defined between the inner and outer walls 30D,30E. Another possible example of the single fluid passage 40 configuration is shown in FIG. 4D. The single fluid passage 40 has an inlet supplied with the thermal transfer fluid 130 by one of the fluid lines 144, an outlet in fluid communication with another one of the fluid lines 144 to supply the cooled thermal transfer fluid 130 thereto, and a body which extends through the housing 30 and between the inlet and outlet. The body of the fluid passage 40 has parallel and interconnected segments which have an orientation substantially perpendicular to the housing center axis 30X. The thermal transfer fluid 130 flows through the segments in a first upward direction, and in a second downward direction. The length of the single fluid passage 40 is longer than the length of the housing 30 measured along the housing center axis 30X. In the configuration shown in FIG. 4D, the single fluid passage 40 is the only fluid passage 40 in the space/thickness defined between the inner and outer walls 30D,30E. It will be appreciated that, at least in the configurations shown in FIGS. 4C and 4D, locating the fluid passages 40 in the housing 30 both exposes the thermal transfer fluid 130 therein to a relatively high-velocity flow of water through the interior 30A of the housing 30, and also allows for providing long fluid passages 40 so as to increase their cooling surface area. Another possible example of the single fluid passage 40 has an inlet supplied with the thermal transfer fluid 130 by one of the fluid lines 144, an outlet in fluid communication with another one of the fluid lines 144 to supply the cooled thermal transfer fluid 130 thereto, and a body which extends through the housing 30 and between the inlet and outlet. The body of the fluid passage 40 has a spiral configuration that wraps around the circumference and about the housing center axis 30X of the housing 30.

Yet another possible position of the fluid passages 40 relative to the housing 30 is shown in FIG. 4B. The housing 30 includes static guide features, such as stator vanes 30V, which extend from the inner wall 30D radially inwardly into the interior 30A of the housing 30 relative to the housing center axis 30A. The stator vanes 30V extend radially inwardly to a hub 30H of the housing 30, which is coaxial with the housing center axis 30X and centrally located in the interior 30A of the housing 30. The stator vanes 30V may help to decrease the losses caused by the swirling flow emanating from the rotating impeller 15. The stator vanes 30V are circumferentially spaced apart to help guide and deswirl the flow of water through the interior 30A. Referring to FIG. 4B, the stator vanes 30V and the hub 30H are present in only the downstream portion 30G of the housing 30, and are located downstream of the impeller 15. Referring to FIG. 4B, one or more of the fluid passages 40 are vane fluid passages 40V that extend through, or are present within, one or more of the stator vanes 30V. The vane fluid passages 40V extend along a substantially radial direction relative to the housing center axis 30X, and are in fluid communication with the fluid passages 40 that are positioned radially outwardly in the housing 30 so as to receive the warmer thermal transfer fluid 130 from these fluid passages 40 and circulate the cooler thermal transfer fluid 130 back to them. Placing one or more of the fluid passages 40 in the stator vanes 30V helps to increase the cooler surface area to which the thermal transfer fluid 130 can be exposed, and may improve heat transfer between the thermal transfer fluid 130 and the water flowing by the stator vanes 30V. Positioning the fluid passages 40 in the stator vanes 30V may provide effective thermal transfer since there is fluid flow on both sides of the stator vanes 30, thereby exposing the thermal transfer fluid 130 to increased surface area for cooling.

Yet another possible position of the fluid passages 40 relative to the housing 30 is shown in FIG. 4B. One or more of the fluid passages 40 are hub fluid passages 40H which extend along, or are present within, the hub 30H. The hub fluid passages 40H extend along a substantially circumferential direction about the housing center axis 30X, and are in fluid communication with the vane fluid passages 40V so as to receive the warmer thermal transfer fluid 130 from the vane fluid passages 40V, and so as to circulate the cooler thermal transfer fluid 130 back to them. Placing one or more of the fluid passages 40 in the hub 30H helps to increase the cooler surface area of the housing 30 to which the thermal transfer fluid 130 can be exposed, and may improve heat transfer between the thermal transfer fluid 130 and the water flowing by the hub 30H.

Yet another possible position of the fluid passages 40 relative to the housing 30 is shown in FIG. 4B. One or more of the fluid passages 40 extends circumferentially through the housing 30 or part thereof between the inner and outer walls 30D,30E about the housing center axis 30X. The cooling fluid passages 40 may spiral through the housing 30 and about the housing center axis 30X between the inlet 30B and the outlet 30C of the housing 30.

Figure 7:
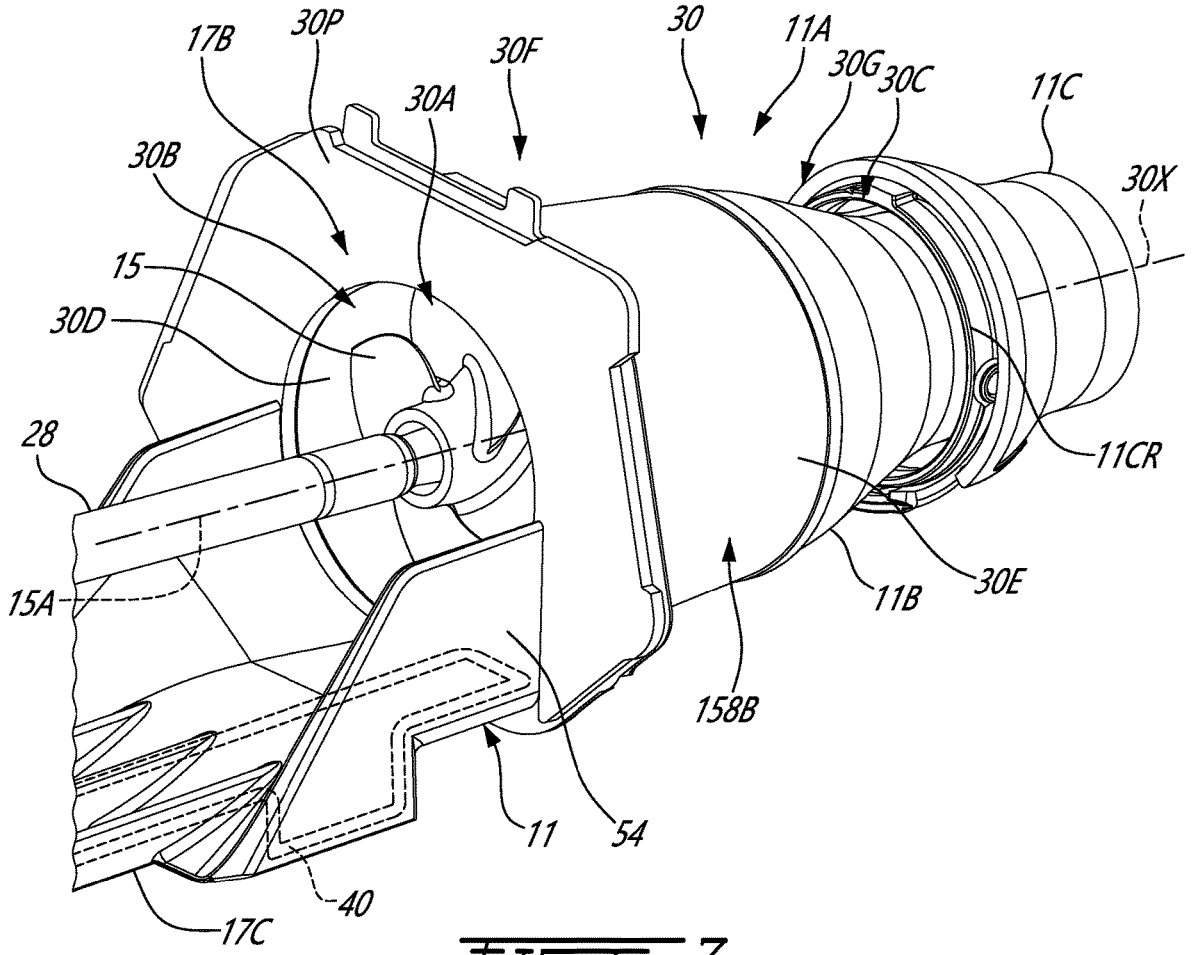
FIG. 7 is another rear perspective view of a jet propulsion system of the watercraft of FIG. 1.

Yet another possible position of the fluid passages 40 is shown in FIGS. 3A and 3B. The grate 17C of the water intake 17 is connected, mounted or adjacent at one of its ends to a pump shoe 54. One or more of the fluid passages 40 may be present within the members of the grate 17C and/or within the pump shoe 54. Referring to FIGS. 3A and 3B, one or more fluid passages 40 is present within the members of the grate 17C and within the pump shoe 54. In an alternate embodiment, the one or more fluid passages 40 is present within only the members of the grate 17C, or only within the pump shoe 54. Placing one or more of the fluid passages 40 in the grate 17C and/or in the pump shoe 54 helps to increase the cooling surface area to which the thermal transfer fluid 130 can be exposed at all operating phases of the PWC 10 (e.g. high speed, low speed, floating), since the grate 17C and the pump shoe 54 are submerged in the water during all operating phases of the PWC 10. In an embodiment, an example of which is shown in FIGS. 3A and 3B, the fluid cooling passages 40 are present in the housing 30 (according to one or more of the configurations disclosed herein) and outside of the housing 30 in the grate 17C and/or in the pump shoe 54. In an alternate embodiment, an example of which is shown in FIG. 7, the fluid cooling passages 40 are present only in the grate 17C and/or in the pump shoe 54. In the configuration of FIG. 7, the housing 30 is free of fluid passages 40.

The fluid passages 40 may have other orientations as well, such as being vertically oriented to convey the thermal transfer fluid up and down, being horizontally oriented to convey the thermal transfer fluid back and forth in directions parallel to the housing center axis 30X, and any orientation therebetween. Determining the appropriate orientation, configuration and/or positioning of the fluid passages 40 within the housing 30, grate 17C and/or pump shoe 54 may be based on the requirements of a given PWC 10. Similarly, the cross-sectional shape of the fluid passages 40, defined in a plane normal to the direction of flow of thermal transfer fluid 130 through the fluid passages 40, may vary. The cross-sectional shape of the fluid passages 40 may be circular, polygonal, elliptical, oval, flat-bottomed against the inner or outer wall 30D,30E, and any other suitable shape. The examples of possible positions for the fluid passages 40 show that they may be integrated into many or all of the surfaces of the stator components of the housing 30.

Figure 5A:
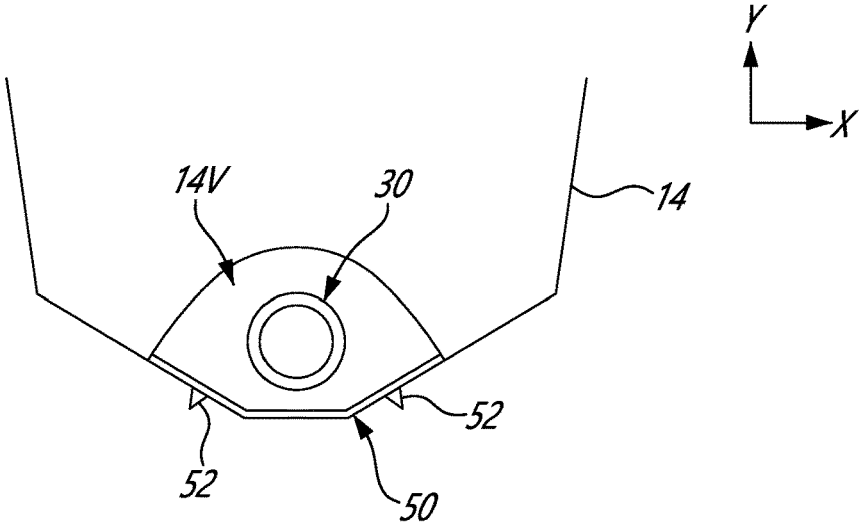
FIG. 5A is a rear view of a hull of the watercraft of FIG. 1 showing a ride plate.
Figure 5B:
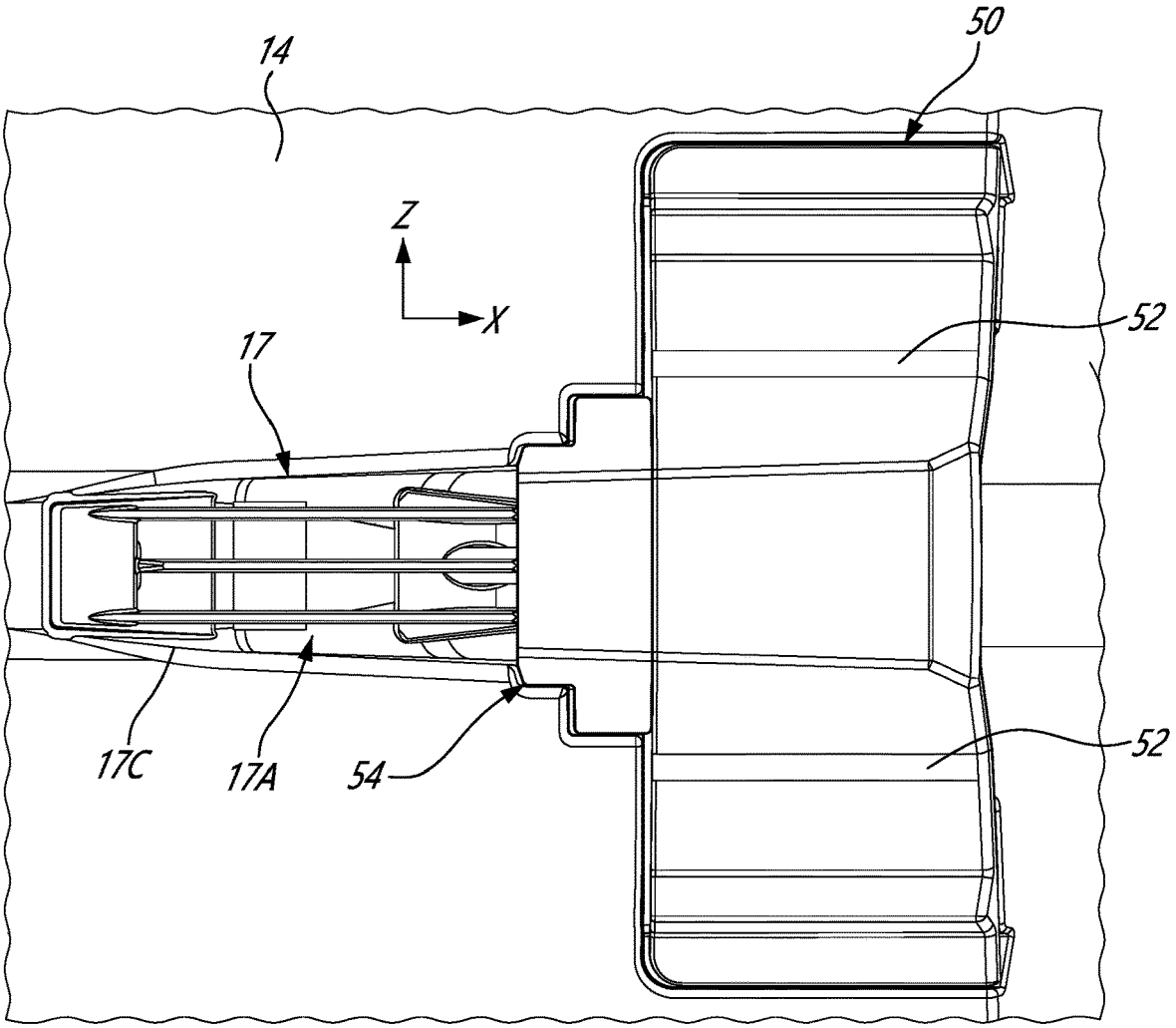
FIG. 5B is a bottom view of the hull and ride plate of FIG. 5A.

Referring to FIGS. 5A and 5B, the PWC 10 includes a ride plate 50. The ride plate 50 is an object that is mounted to the bottom of the hull 14. The hull 14 defines the jet pump tunnel 14V along a bottom portion thereof in which one or more components of the jet propulsion system 11 are located. The ride plate 50 extends between bottom walls of the hull 14 to delimit the bottom of the jet pump tunnel 14V. The ride plate 50 is submerged in water when the PWC 10 is floating in water or being used. Referring to FIGS. 5A and 5B, the ride plate 50 is a planar body comprised of one or more planar wall sections. The grate 17C of the water intake 17 is mounted to the ride plate 50 via the pump shoe 54 which covers part of the water intake 17 and protects from debris entering the water intake 17. The ride plate 50 is positioned underneath the jet pump housing 30 to cover the underside of the jet pump tunnel 14V. Referring to FIGS. 5A and 5B, the ride plate 50 is a solid body or plate. The ride plate 50 is free of internal passages or internal cavities. The absence of internal passages within the ride plate 50 may allow for more flexibility in its design, it being understood that the ride plate 50 may impact the performance of the PWC 10 (i.e. such as on the trim of the PWC 10, which is its pitch in an up and down direction). The absence of internal passages within the ride plate 50 may allow for the ride plate 50 to be made by being stamped from a sheet of metal, instead of being casted which is a more complicated manufacturing procedure. The absence of internal passages within the ride plate 50 may allow for the designer of the ride plate 50 to play with its geometry in order to provide optimal hydrodynamic performance. The absence of internal passages within the ride plate 50 may allow for the ride plate of an existing PWC 10 to be more easily replaced or upgraded.

The absence of internal passages within the ride plate 50 may allow for the designer of the ride plate 50 to play with its design to provide it with features that may increase the stability or cornering of the PWC 10. For example, and referring to FIG. 5A, the ride plate 50 has one or more strakes 52. The strakes 52 are geometric features that project outwardly from the ride plate 50 into the water, and which impact the maneuverability of the PWC 10, such as its trim. Referring to FIG. 5A, the strakes 52 are protrusions or fins extending from the ride plate 50, and which extend along a length of the ride plate 50. The ride plate 50 may also be designed to increase its size behind the PWC 10 in order to provide more planning surface.

Figure 6:
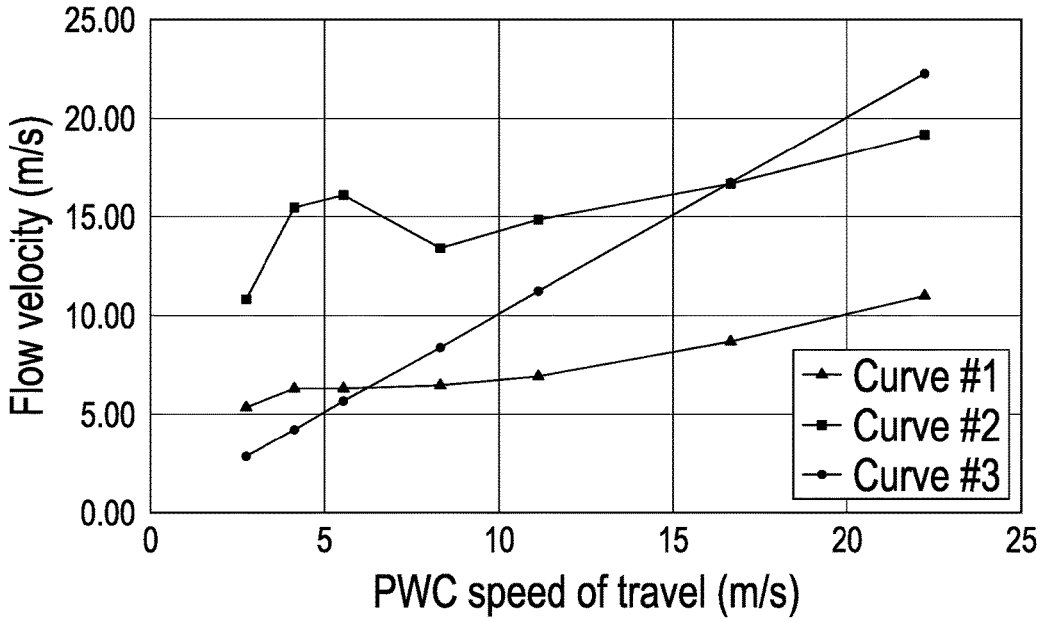
FIG. 6 is a graph of flow velocities.

The fluid passages 40 disclosed herein offer beneficial cooling at relative low to moderate speeds of travel of the PWC 10. FIG. 6 is one possible and non-limiting plot of the flow velocity through the jet pump 11 as a function of the speed of travel of the PWC 10. Curve #1 represents the flow velocity through the water intake 17 and at the inlet 30B of the jet pump housing 30. As can be seen, the flow velocity at the inlet 30B does not increase substantially as the travel speed of the PWC 10 increases. Curve #2 represents the flow velocity at the outlet 30C of the jet pump 11 after the impeller 15 has pressurized the water and the water has been constricted by the downstream portion 30G of the housing 30. As can be seen, the flow velocity at the outlet 30C is greater than the flow velocity of Curve #1, and greater than the speed of travel of the PWC 10 for most values for the speed of travel. Curve #1 and Curve #2 indicate that at high travel speeds for the PWC 10 (i.e. greater than 15 m/s), the water intake 17 and jet pump 11 cannot absorb the high flow rate of water caused by the high travel speed, such that the water intake 17 decelerates the water before it is re-accelerated by the impeller 15 and the constricting downstream portion 30G of the jet pump housing 30. Curve #3 represents the flow velocity along the ride plate 50. The flow velocity of Curve #3 increases more substantially as the travel speed does compared to the increase in flow velocity for Curve #1 and for Curve #2. The flow velocity of Curve #3 increases linearly with the travel speed of the PWC 10.

At lower travel speeds of the PWC 10 (e.g. around 7 m/s), the flow velocity through the jet pump 11 (represented by the flow velocity through the water intake 17 of Curve #1, and by the flow velocity at the outlet 30C of Curve #2), and particularly the flow velocity from the outlet 30C, is greater than the speed of travel of the PWC 10 and thus greater than the flow velocity along the ride plate 50 of Curve #3. Thus, at this lower travel speed, the cooling provided by the water to the fluid passages 40 by the housing 30, as well as optionally by the pump shoe 54 and the grate 17C is greater than the cooling provided by the water to any cooling passages that might be in the ride plate 50. Furthermore, at such lower travel speeds, the housing 30 may be partly or completely submerged in the water, which may further enhance the cooling effect of the water on the fluid passages 40 in the housing 30 since the housing 30 is exposed to flow velocity along both its inner wall 30D and outer wall 30E.

At moderate travel speeds of the PWC 10 (e.g. between about 7 m/s to about 15 m/s), the flow velocity through the jet pump 11 (represented in Curve #2 by the flow velocity at the outlet 30C of the jet pump 11) is still greater than the flow velocity along the ride plate 50 of Curve #3. Thus, at this moderate travel speed, the cooling provided by the water to the fluid passages 40 in the housing 30 may be greater than the cooling provided by the water to any cooling passages that might be in the ride plate 50. Furthermore, at such moderate travel speeds, the housing 30 may be partly or completely submerged in the water, which may further enhance the cooling effect of the water on the fluid passages 40 in the housing 30.

At higher travel speeds of the PWC 10 (e.g. greater than 15 m/s), the flow velocity through the jet pump 11 (represented by the flow velocity through the water intake 17 of Curve #1, and by the flow velocity at the outlet 30C of Curve #2) may be less than the speed of travel of the PWC 10 and the flow velocity along the ride plate 50 of Curve #3. Thus, at this higher travel speed, the cooling provided by the water to the fluid passages 40 in one or more of the housing 30, the pump shoe 54 and the grate 17C may be less than the cooling provided by the water to any cooling passages that might be in the ride plate 50. However, as described above, the PWC 10 is not expected to operate at these higher travel speeds for prolonged periods of time, such that the cooling effectiveness of the fluid passages 40 disclosed herein will be available once more when the PWC 10 eventually returns to the lower or moderate travel speeds. Furthermore, even at these higher travel speeds, positioning the fluid passages 40 in one, some or all of the housing 30, the pump shoe 54 and the grate 17C may provide increased cooling surface area compared to any cooling passages that might be in the ride plate 50, and may therefor still provide better cooling.

Referring to FIG. 2, there is disclosed a method of cooling the thermal transfer fluid 130 during operation of the PWC 10. The method includes conveying the thermal transfer fluid 130 through one or more fluid passages 40 within the housing 30 to release heat from the thermal transfer fluid 130 to water flowing around the one or more fluid passages 40.

Referring to FIGS. 3A and 3B, there is disclosed a method of manufacturing the housing 30 for the jet pump 11A. The method includes forming the interior 30A of the housing 30. The method includes forming one or more fluid passages 40 in the housing 30 to be in heat exchange relationship with one or both of an inner wall 30D and an outer wall 30E of the housing 30. The method may include casting the housing 30 with its interior 30A. The method may include casting the housing 30 with a sacrificial material therein. The sacrificial material occupies or is otherwise representative of the locations of the fluid passages 40 that are formed by the casting process. The method may include removing the sacrificial material after casting the housing 30 in order to form the fluid passages 40. In some instances, the jet pump housing 30 is already a casted part and thus could be manufactured to include the fluid passages 40 directly within the housing 30. The sacrificial material may be used to form the fluid passages 40 during the casting process and then flushed out once casting is finished so as to leave the hollow fluid passages 40 remaining. The incremental cost to form the fluid passages 40 while casting the housing 30 may be minimal.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, while some of this disclosure relates to an electric vehicle, the fluid passages 40 disclosed herein are equally applicable to cool components of a vehicle displaced by an internal-combustion engine. In such a case, the components being cooled may include the internal-combustion engine. Yet further modifications could be implemented by a person of ordinary skill in the art in view of the present disclosure, which modifications would be within the scope of the present technology.

The invention claimed is:

1. A personal watercraft, comprising:

a jet propulsion system, including:

a jet pump housing extending between an inlet of the jet pump housing and an outlet of the jet pump housing, the jet pump housing having an inner wall delimiting an interior of the jet pump housing and an outer wall, the inner wall and the outer wall configured to be exposed to water during use of the personal watercraft, the jet pump housing having one or more fluid passages positioned between the inner wall and the outer wall, the one or more fluid passages fluidly isolated from the water and in heat exchange relationship with the water via one or both of the inner wall and the outer wall; and an impeller positioned within the interior of the jet pump housing and rotatable about an impeller axis to draw the water into the interior of the jet pump housing via the inlet and to expel water from the outlet; and a thermal management system having a pump and fluid lines extending between the pump and the one or more fluid passages of the jet pump housing, the pump operable to convey a thermal transfer fluid through the fluid lines to one or more components of the personal watercraft to absorb heat from the one or more components, the pump operable to convey the thermal transfer fluid through the fluid lines to the one or more fluid passages of the jet pump housing to release the heat to the water.

2. The personal watercraft of claim 1, wherein the one or more fluid passages are positioned closer to the inner wall than to the outer wall.

3. The personal watercraft of claim 1, wherein the inner wall forms a heat-transfer wall separating the one or more fluid passages from the interior of the jet pump housing.

4. The personal watercraft of claim 1, wherein the jet pump housing includes an upstream portion defining the inlet of the jet pump housing and a downstream portion defining the outlet, the one or more fluid passages extending through one or both of the upstream portion and the downstream portion.

5. The personal watercraft of claim 1, wherein the jet pump housing includes stator vanes extending from the inner wall into the interior, one or more of the one or more fluid passages present within the stator vanes.

6. The personal watercraft of claim 1, wherein the jet pump housing includes stator vanes extending from the inner wall to a hub in the interior of the jet pump housing, one or more of the one or more fluid passages present within the stator vanes and within the hub.

7. The personal watercraft of claim 1, comprising a water intake in fluid communication with the inlet and defining an upstream opening covered by a grate, the grate having one or more grate fluid passages in fluid communication with the one or more fluid passages.

8. The personal watercraft of claim 1, wherein the jet pump housing is an annular body defining a housing center axis, one or more of the one or more fluid passages extending circumferentially about the housing center axis.

9. The personal watercraft of claim 1, comprising a ride plate positioned underneath the jet pump housing, the ride plate being free of internal passages.

10. The personal watercraft of claim 1, comprising a ride plate positioned underneath the jet pump housing, the ride plate having one or more strakes.

11. The personal watercraft of claim 9, comprising a pump shoe mounted to the ride plate, the pump shoe having one or more pump shoe fluid passages in fluid communication with the one or more fluid passages.

12. A jet pump housing mountable to a hull of a personal watercraft, the jet pump housing comprising: a body extending between an inlet of the jet pump housing and an outlet of the jet pump housing, the body having an inner wall delimiting an interior of the body and an outer wall, the inner wall and the outer wall configured to be exposed to water during use of the personal watercraft, the body shaped and sized to house an impeller of a jet pump in the interior of the body and allow water to flow into the interior via the inlet and to expel water from the outlet, the body having one or more fluid passages positioned between the inner wall and the outer wall, the one or more fluid passages fluidly isolated from the water and in heat exchange relationship with the water via one or both of the inner wall and the outer wall.

13. The jet pump housing of claim 12, wherein the one or more fluid passages are positioned closer to the inner wall than to the outer wall.

14. The jet pump housing of claim 12, wherein the inner wall forms a heat-transfer wall separating the one or more fluid passages from the interior of the body.

15. The jet pump housing of claim 12, wherein the body includes an upstream portion defining the inlet of the body and a downstream portion defining the outlet, the one or more fluid passages extending through one or both of the upstream portion and the downstream portion.

16. The jet pump housing of claim 12, wherein the body includes stator vanes extending from the inner wall into the interior, one or more of the one or more fluid passages present within the stator vanes.

17. The jet pump housing of claim 12, wherein the body includes stator vanes extending from the inner wall to a hub in the interior of the housing, one or more of the one or more fluid passages present within the stator vanes and within the hub.

18. The jet pump housing of claim 12, wherein the body is an annular body defining a housing center axis, one or more of the one or more fluid passages extending circumferentially about the housing center axis.

19. A personal watercraft, comprising:

a hull defining a water intake extending along a bottom portion of the hull, the water intake defining an opening covered by a grate;

a ride plate positioned along the bottom portion of the hull;

a pump shoe extending between the grate and the ride plate;

one or more fluid passages positioned in one or both of the grate and the pump shoe; and a thermal management system having a pump and fluid lines extending between the pump and the one or more fluid passages, the pump operable to convey a thermal transfer fluid through the fluid lines to one or more components of the personal watercraft to absorb heat from the one or more components, the pump operable to convey the thermal transfer fluid through the fluid lines to the one or more fluid passages to release the heat to the water.

20. The personal watercraft of claim 19, wherein the ride plate is free of internal passages.

* * * * *